United States Patent [19]

Corsette

[11] 4,402,432

[45] Sep. 6, 1983

[54] LEAK-PROOF DISPENSING PUMP

[76] Inventor: Douglas F. Corsette, 6559 Firebrand St., Los Angeles, Calif. 90045

[21] Appl. No.: 121,223

[22] Filed: Feb. 13, 1980

[51] Int. Cl.[3] ..... B05B 11/00

[52] U.S. Cl. ..... 222/321; 222/380; 222/383; 222/401

[58] Field of Search ..... 222/321, 380, 381, 383; 239/333

[56] References Cited

U.S. PATENT DOCUMENTS

| | | | |
|---|---|---|---|
| 3,333,549 | 8/1967 | Cooprider | 222/383 X |
| 4,050,613 | 9/1977 | Corsette | 222/321 |
| 4,173,297 | 11/1979 | Pettersen | 222/380 X |
| 4,174,056 | 11/1979 | Loeffler | 222/321 |
| 4,183,449 | 1/1980 | Blake | 222/321 |
| 4,225,060 | 9/1980 | Kutik et al. | 222/380 X |
| 4,249,676 | 2/1981 | Beery | 222/383 X |
| 4,249,681 | 2/1981 | French | 222/321 X |

FOREIGN PATENT DOCUMENTS

| | | | |
|---|---|---|---|
| 244406 | 1/1961 | Australia | 222/383 |

*Primary Examiner*—Joseph J. Rolla
*Assistant Examiner*—Frederick R. Handren
*Attorney, Agent, or Firm*—Watson, Cole, Grindle & Watson

[57] ABSTRACT

A dispensing pump having a unitary plunger defining a main pump chamber and functioning as a discharge valve upon accumulation of pressure causing the plunger to shift open, includes a container vent which is positively sealed against leakage therethrough even upon nudging the plunger during storage, shipment and handling of the pump.

The pump includes a fixed position and a reciprocable plunger head having a discharge passage, the inside of the head and the top of the piston being complementarily contoured for expelling accumulated air from the pump chamber directly out of the discharge during priming. Otherwise, the pump chamber may be placed in communication with a vent chamber which opens into the container through the vent so that any accumulated air in the pump chamber may be vented into the container as an aid in priming.

The volume beneath the plunger head may be enclosed as an air chamber so that the air therein may be vented into the container upon opening the container vent to assist in pump priming. And, the plunger is designed to effect a quick or a slow opening of the discharge passage.

15 Claims, 6 Drawing Figures

LEAK-PROOF DISPENSING PUMP

BACKGROUND OF THE INVENTION

This invention relates to a dispenser having a container vent opening which is positively sealed against leakage therethrough even when slightly nudging the plunger head. More particularly, the pump according to the invention relates to an improvement over my prior U.S. Pat. No. 4,050,613 and is designed to vent accumulated air from the pump chamber directly to the atmosphere for priming or to vent such accumulated air into the container to aid in pump priming. The pump may have a quick opening or a slow opening discharge and make take advantage of compressed air beneath the plunger head for boosting the product in the container to aid in pump priming.

Dispensing pumps are typically provided with a container vent to permit equalization of pressures within and outside the container during pump actuation. However, these container vents are so disposed as to be quite sensitive to opening so that a top load on the plunger will displace the vent seal or other flow passage seal, or both, so as to cause leakage during normal conditions of storage, shipping and handling. Also, a slight nudge of the pump head after the pump is primed is apt to open the vent seal and cause an unwanted leak of the product from the container. An overcap or other means must therefore be provided to hold the plunger in a fully compressed position or in a fully extended position to avoid accidental plunger reciprocation. And, in many of the prior art pumps the container vent opening is located in the wall of the pump chamber and a relief groove or rib is provided in the pump chamber for releasing accumulated air into the atmosphere via the sensitively controlled vent. Little, if any, of this accumulated air is therefore capable of entering the container for boosting the product as an aid in pump priming. And, the opening of the discharge is typically not controlled for quick or slow opening depending on the use intended for the pump or the type of product to be dispensed.

SUMMARY OF THE INVENTION

It is therefore an object of this invention to provide a dispensing pump which is not only substantially leakproof but is capable of directing air purged from the pump chamber into the container to aid in priming and to choose the point at which compressed air from the pump chamber is released for dumping it under pressure into the container at a chosen point of the container vent opening. Also, the volume of space under the plunger head may be enclosed and air therewithin may be compressed and vented into the container through the vent opening for further assisting in priming. Such compressed air may constitute the primary priming aid with accumulated air within the pump chamber being alternatively vented directly through the discharge. And, the discharge opening according to the invention may be opened slowly or quickly as desired.

Another object of the invention is to provide a dispensing pump, of the type having a plunger mounted for reciprocating on a fixed piston to define a variable volume pump chamber, and having a plunger head slideably disposed on the plunger and therewith defining a variable volume accumulation chamber in communication with the pump chamber, the plunger functioning as a valve for closing a discharge passage located in the plunger head, container vent opening and closing means taking the form of a resilient skirt on the plunger in sealing engagement with a cylindrical wall surrounding and spaced from the piston, the container vent opening into a vent chamber defined by the cylindrical wall and the piston, and a container vent passage extending from the interior of the container through the vent opening and vent chamber, outwardly of the plunger and outwardly of the plunger head whereupon the skirt functions to close the vent passage in a raised discharge closing position of the pump and during an initial downstroke reciprocation of the plunger. The skirt is adapted to open the vent passage upon a further downstroke reciprocation so that the interior of the container is vented to atmosphere only during such further downstroke reciprocation, and any leakage of product from the container through the vent passage is positively prevented while the plunger is in its raised position and during such initial downstroke.

A further object of the present invention is to provide such a dispensing pump wherein the top of the fixed piston and an opposing inner surface of the plunger head are complementarily contoured to effect a substantially complete evacuation of the pump chamber during priming whereupon the plunger is caused to shift downwardly to open the discharge for venting the accumulated air therethrough.

A still further object of this invention is to provide such a dispensing pump wherein the pump may be primed by establishing communication between the pump chamber and the vent chamber near the end of the downstroke for evacuating accumulated air from the pump chamber into the container to aid in priming by boosting the product up the dip tube.

A still further object is to provide such a pump wherein such communication is established by providing a rib on the plunger for distorting a lip seal on the piston.

A still further object is to provide such a dispensing pump wherein an additional priming assist is made possible by enclosing the volume of space beneath the plunger head so as to define an air chamber in which the air is compressed during depression of the head and is vented directly into the container via the open container vent at a predetermined point along the downstroke of the plunger.

A still further object of this invention is to provide such a dispensing pump wherein the upper end of the plunger has a flange defining a discharge valve, a terminal end thereof either lying above the discharge opening for effecting a slow discharge opening or lying below the discharge passage for effecting a quick discharge opening.

Other objects, advantages and novel features of the invention will become more apparent from the following detailed description of the invention when taken in conjunction with the accompanying drawings.

DETAILED DESCRIPTION OF THE INVENTION

Figure 1:
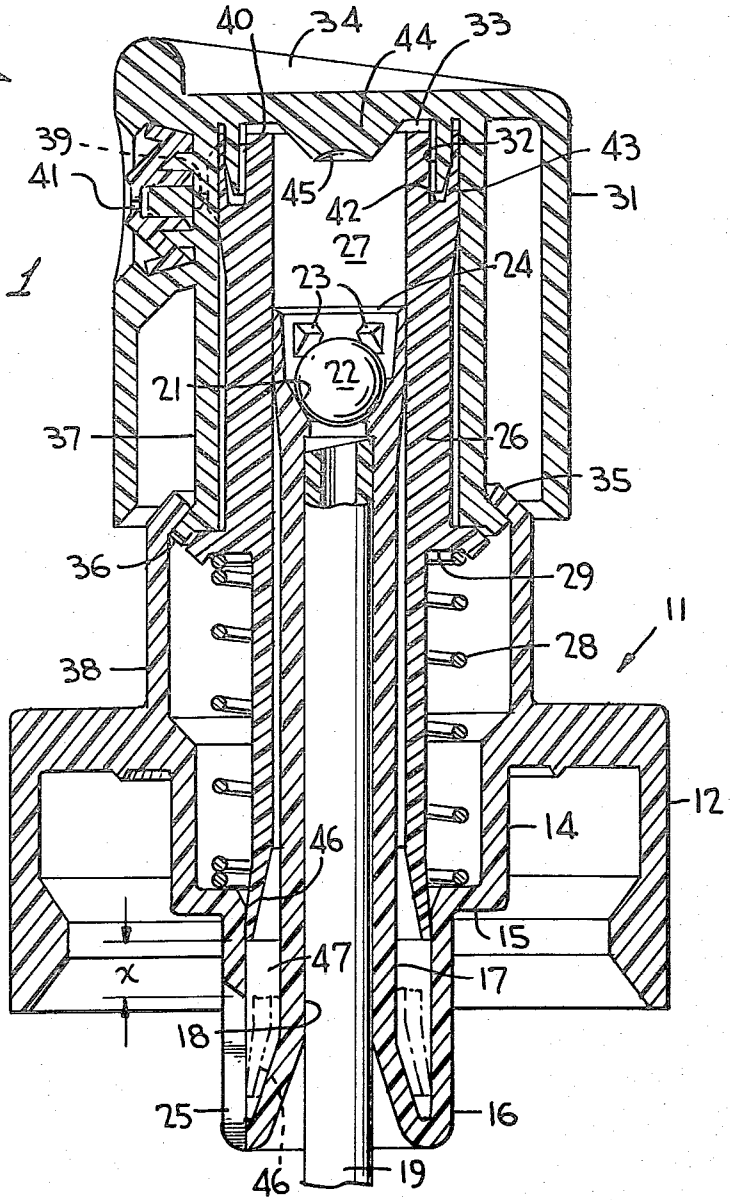
FIG. 1 is a vertical sectional view of an embodiment of a dispensing pump according to the invention.

Turning now to the drawing wherein like characters refer to like and corresponding parts throughout the several views, a pump assembly is generally designated 10 in FIG. 1 and is essentially the same as that shown in my prior U.S. Pat. No. 4,050,613. The entirety of that patent is therefore specifically incorporated herein by reference. It will be seen that the pump assembly comprises a pump body 11 including an integral cap 12 for snapping onto the opening of a container (not shown) of flowable product to be dispensed. Of course, the cap may be separate from the pump body as shown at 13 in FIG. 2, and the cap may be designed to be threaded onto the container neck as shown in FIGS. 3 to 6.

Pump body 11 includes an annular sleeve 14 having a shoulder 15 from which a cylindrical wall 16 depends. This wall surrounds and is slightly spaced from a stationary upstanding piston 17 with which it is connected, the piston having an inlet passage 18 extending therethrough which receives and is coupled to a conventional dip-tube 19 having its lower end extending into the product to be dispensed from the container. An inlet valve is provided at the upper end of the piston in the form of a ball seat 21, a ball valve 22 seated thereon for closing inlet passage 18 during the compression stroke, and a plurality of detents located on an annular lip 24 provided at the upper end of the piston and being spaced slightly upwardly of the ball valve to permit unseating thereof during the suction stroke. An elongated container vent 25 extends through a lower portion of the wall 16 so as to permit equalization of pressures within and outside the container as in the conventional manner so as to replace the product dispensed from the container with air to avoid collapse of the container and a pressure lock condition within the pump. A tubular plunger 26 encircles and cooperates with the stationary piston and is reciprocable thereon to define therewith a variable volume pump chamber 27. A coil spring 28 extends between shoulder 15 and a flange 29 on the plunger for resiliently urging the plunger upwardly toward its fully raised position and normally maintaining it in that position.

A plunger discharge head 31 has a downwardly directed blind socket 32 which snugly and slidably receives plunger 26 and defines therewith an enclosed variable volume accumulation chamber 33 communicating through the tubular plunger with the valve controlled upper end of inlet passage 18. This accumulation chamber 32 has an appreciably larger diameter than the pump chamber, and the annular upwardly presented end of the plunger is exposed to downward fluid pressure within the accumulation chamber in opposition to the upward thrust of return spring 28.

The plunger head is formed at its upper end as having a finger piece 34 so that intermittent finger pressure conveniently applied to it may be transmitted to plunger 26 for producing reciprocation thereof on stationary piston 17, each depression of the plunger being yieldably resisted by spring 28 which will return the plunger to its fully raised position following each withdrawal of finger pressure.

Upward movement of the plunger head is positively limited by any suitable means such as annular cooperating stop shoulders or ribs 35, 36, respectively provided on a skirt 37 depending from the plunger head and an upstanding cylindrical wall 38 on the pump body. These stop shoulders, as compared to similar stops disclosed in my prior aforementioned patent, need not sealingly engage one another in the raised plunger position of FIG. 1 since, as will be seen, leakage of product through the container vent with the plunger in the FIG. 1 position is positively prevented and leakage is likewise prevented even after an initial plunger downstroke.

A discharge orifice 39 defining a discharge passage extends through the wall of the plunger head and is adapted, as in any normal manner, to convey the dispensed product from the accumulated chamber into the atmosphere through an adjacent nozzle 41. And, as in my prior patent mentioned earlier, the discharge orifice opens into the blind socket below the blind upper end thereof at a location such that its upper end is normally covered by the plunger when the latter is projected into its fully upward position as in FIG. 1 into the blind end of the socket 33 by spring 28.

The plunger at its upper end has an annular groove 42 defining an annular discharge valve flange 43 having an upper end lying slightly above the discharge orifice. This flange bears against a ring 40 provided on the plunger head so as to thereby establish the accumulation chamber. The discharge passage is therefore opened more slowly during relative reciprocation between the plunger and the piston, as compared to that disclosed in FIG. 5 which will be more clearly described hereinafter.

The upper inner end of the plunger head has a downward extension 44 with a part-spherical inner end 45 for matching the contour of the upper end of the piston defined by a portion of the ball valve and by detents 23 and lip 24. The upper end of the piston and the opposing inner end of the plunger head are therefore complementarily contoured so that when brought in face-to-face contact during a depression of the head, before the dispensing operation, any air which accumulated in pump chamber 27 may be substantially purged by venting it through the discharge as that air is compressed and acts on the larger diameter accumulation chamber so as to shift the plunger relative to the discharge for the opening of same.

In pump manufacture, the pump is typically shipped to the consumer goods manufacturer, such as a cosmetics firm, in the un-primed, sealed condition. The manufacturer will then typically apply the pumps to his containers directly from the pump manufacturers shipping carton. Thus, it is a nuisance and a substantial added expense if it were necessary for him to apply one or more priming strokes to the pump after being assembled to a filled container. Hence, there is a need to expel the air from the pump chamber in as expeditious a manner as possible. The air may be purged according to the invention as aforedescribed, i.e., by first depressing the plunger head so that the compressed air in the pump chamber forces the plunger downwardly on the piston via action on the accumulation chamber to thereby open the discharge so that, once opened, the plunger head may be depressed until surface 45 contacts the ball valve so as to effectively squeeze all the accumulated air out of the pump chamber.

Subsequent intermittent finger pressure on the plunger head functions to prime the pump by drawing the flowable product upwardly through the dip tube and the hollow piston into the pump chamber. After the pump is primed, initial downstroke of the plunger head causes the plunger to move downwardly on the piston during the compression stroke, thereby compressing spring 28. As the compression stroke continues, there will manifestly be a progressively increasing fluid pressure within accumulation chamber 33 until such pressure creates a downward force on the plunger sufficient to overcome the resilient upward thrust of of the spring. This will result in downward movement of the plunger within the plunger head socket sufficient to unseat the plunger from the blind upper end of the socket and to uncover the end of the discharge passage whereby the contents of chamber 27 will be discharged under pressure therethrough. Such discharge will continue so long as the pressure of fluid or product within the accumulation chamber is sufficient to maintain the plunger thus displaced downwardly with respect to the plunger head so as to maintain the discharge passage uncovered.

Then, as similarly described in my aforementioned patent, whenever the pressure within the accumulation chamber becomes insufficient to maintain the discharge passage open, either because of insufficient finger pressure on the plunger head or through discharge of the pump chamber and accumulation chamber contents near the end of the downstroke, the spring pressure will again reseat the plunger within the plunger head socket so as to close the discharge passage. As the finger pressure is released to permit the return stroke, the passage will remain closed and a new charge of product will be drawn into the pump chamber through the unseated inlet ball valve as the plunger and head are restored to their normally raised position by the pump spring.

At its lower end the plunger has a resilient annular skirt 46 in sealing engagement with an inner surface of wall 16, as shown in the upwardly extended position of FIG. 1. Thus, during reciprocation of the plunger relative to the piston as aforedescribed, beyond a distance x and into a position shown in phantom outline in FIG. 1, skirt 46 is moved downwardly below the top of vent 25 to thereby open the vent. It is to be noted that the space between wall 16 and the piston defines a vent chamber 47 in open communication with the interior of the container via vent 25. A vent passage is thereby established via vent 25, vent chamber 47, outwardly of the plunger (when in the vent open position) and outwardly of the plunger head through stop shoulders 35, 36. This vent passage is therefore closed by skirt 46 when in its solid outline position of FIG. 1 and during an initial downstroke of the plunger until it moves in excess of distance x. It can be therefore seen that the vent passage remains closed so as to prevent any leakage of product from the container while the pump is both in its storage and shipping or handling position of FIG. 1 as well as when the plunger head is accidently or otherwise nudged causing downstroke movement of the plunger up to a distance x. Beyond this distance the vent passage is opened as aforedescribed. The size and the location of vent 25 may be chosen so as to vary distance x for the particular product to be dispensed and the type of dispensing operation desired.

Figure 2:
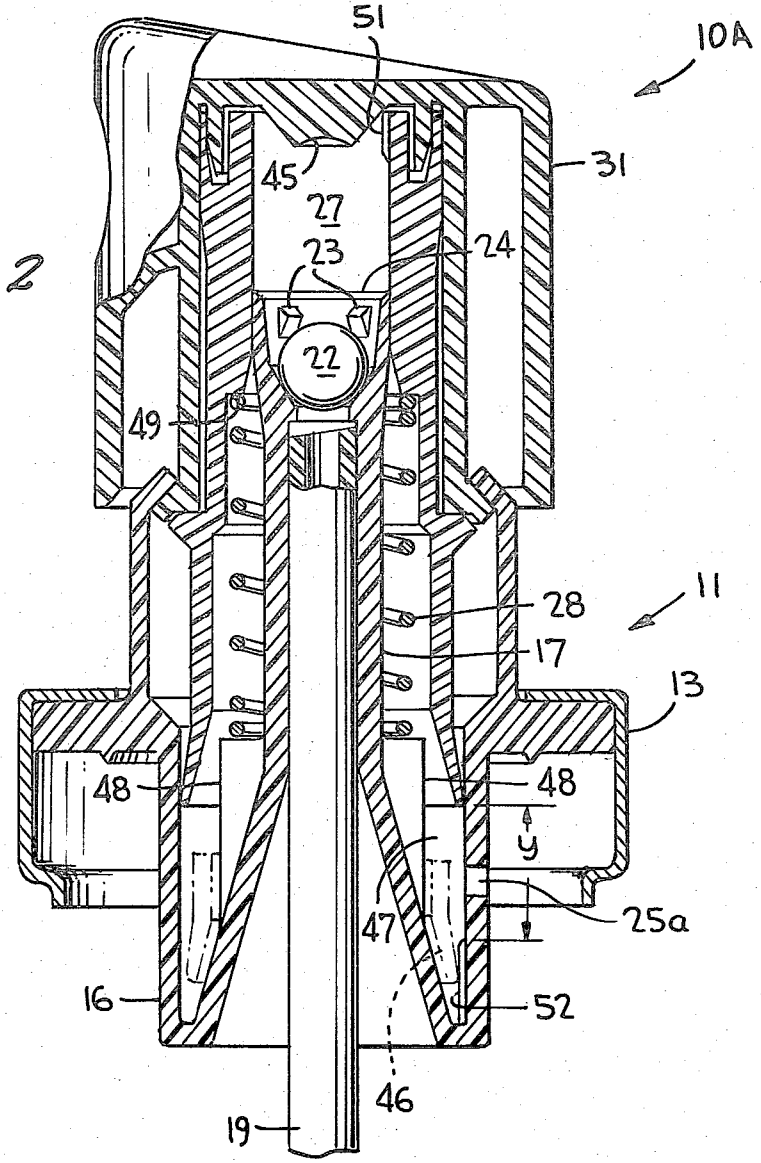
FIG. 2 is a view similar to FIG. 1 of another embodiment.

Pump 10A of FIG. 2 is similar to pump 10 of FIG. 1 so that like parts are given like reference numerals. Return spring 28 is disposed slightly differently in that it extends between abutments 48 extending radially outwardly of the piston and bears against an annular shoulder 49 provided on the plunger. Also, a vent opening 25*a* extends through the lower portion of wall 16 but is spaced from the lower end thereof. The accumulated air in pump chamber 27 is expelled directly into the container in FIG. 2 so as to aid in priming, rather than into the opened discharge passage as in FIG. 1. For this purpose, an elongated axial rib 51 is provided on the inner wall of the plunger at its upper end, and another elongated axial rib 52 is provided on the inner surface of wall 16 at its lower end. Lip 24 and skirt 46 are of resilient material so that, during the downstroke movement of the plunger relative to the piston, lip 24 is distorted upon contact with rib 51 and skirt 46 is distorted upon contact with rib 52 (as shown in phantom outline) so that the pump chamber is placed in communication with vent chamber 47 which opens into the container via vent 25*a*. Thus, accumulated air within the pump chamber is compressed during the downstroke (before dispensing) until the plunger moves beyond a distance y, i.e., until skirt 46 is distorted by its rib 52 for opening the interior of the skirt to the vent passage. This compressed air is therefore vented into the container via vent 25*a* to thereby momentarily compress the liquid surface giving it a modest boost to aid in flowing product up the dip-tube. Vent 25*a* is closed to the atmosphere and to pump chamber 27 in the position of skirt 46 shown in solid outline in FIG. 2. The vent opens to the atmosphere when the plunger skirt moves below the top thereof during inward plunger movement, so that the interior of the container is not vented to atmosphere before this time, as in prior art arrangements. And, vent 25*a* opens to the pump chamber when the plunger moves beyond distance y, so that the compressed accumulated air from the pump chamber is dumped into the container (and partially into the atmosphere) only when vent 25*a* is opened in such manner. This sudden burst of compressed air into the container therefore functions as an aid in priming the pump.

Figure 3:
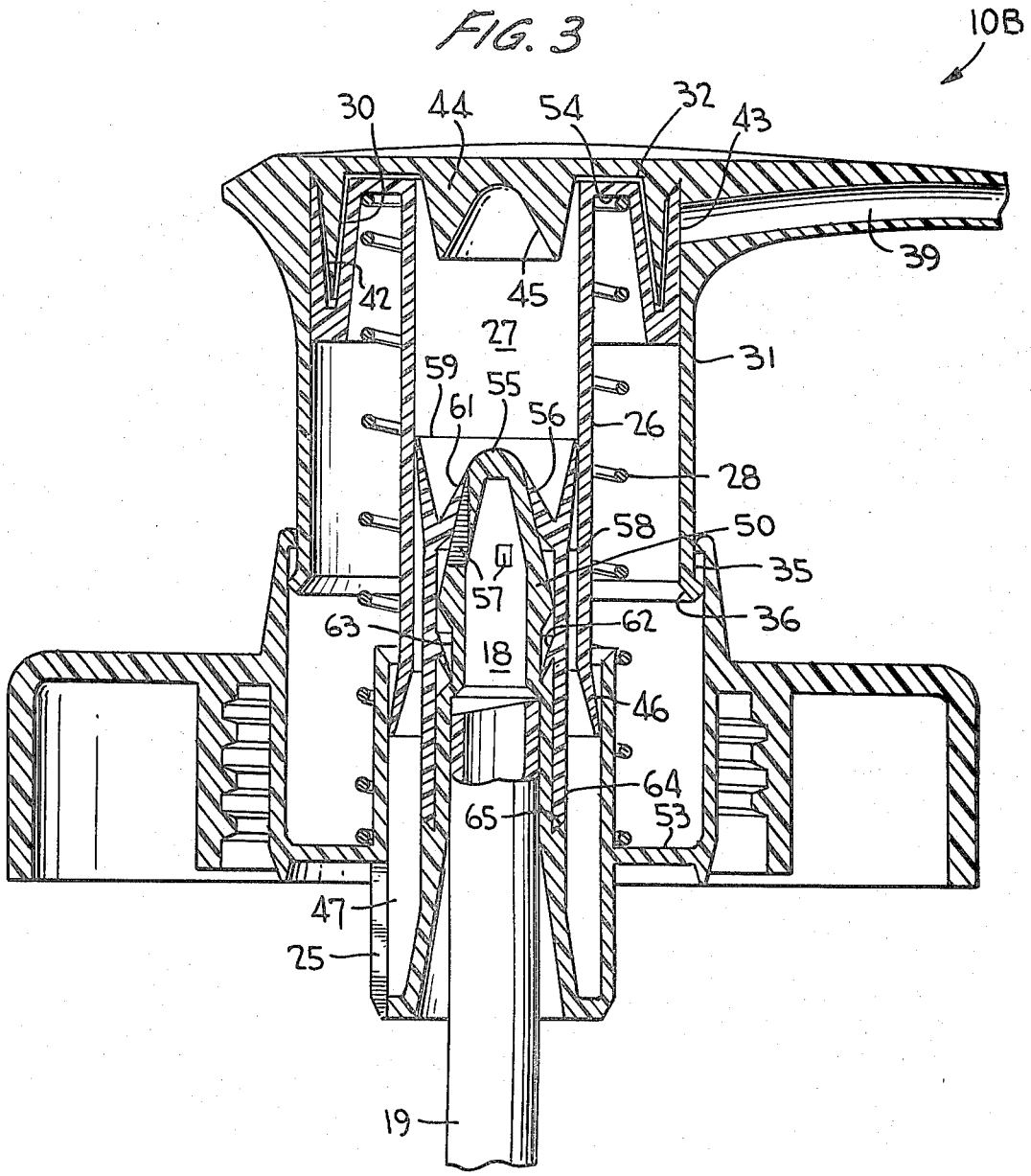
FIG. 3 is a vertical section through the dispensing pump showing a particular inlet valve according to another embodiment.

FIG. 3 discloses a dispensing pump 10B likewise similar to FIG. 1 except that return spring 28 extends between a flange 53 on the pump body and the underside of a flange 54 at the upper end of the plunger. The inlet valve differs in that a stationary pintle 50 is integral with the pump body and is closed at its upper end by a dome portion 55 and a conical surface 56 having a plurality of inlet ports 57 therein. A piston 58 surrounds the pintle and is axially movable relative thereto for opening and closing the inlet ports. The piston has a lip 59 of resilient material at its upper end and a centrally apertured annular flange 61 of conical frustum configuration, the inner surface of the flange sloping to match that of surface 56 and tapering to a paper thin outer edge. This central aperture becomes the intake port of the pump when shifted away from the container by the suction of the intake stroke, and assisted by friction on the plunger wall. When the piston is at its inward limit of travel, the central aperture is closed by plug 55 thereby serving as a check valve for the compression stroke. The piston carries an inwardly directed flange 62 which engages a constriction 63 of the pintle to prevent air from entering the pump chamber on the suction stroke, and to limit travel of the piston outwardly of the container. And, lower end 64 of the piston surrounds the pintle and serves to slidingly guide the piston as it reciprocates thereon and keeps its axis aligned with the piston. This end engages a stop shoulder 65 on the pintle so as to limit the inward travel of the piston to the point where the inlet valve is securely closed and to prevent excessive lost motion of the pumping strokes or undue wedging of the valve members together. This engagement also supports the piston against the force of pump pressure during the compression stroke.

It can be seen that annular groove 42 at the upper end of the plunger is defined by a reversely bent flange having an upper end extending above discharge orifice 39 so that the plunger must travel downwardly during the downstroke a greater distance for opening the discharge as compared to that of FIG. 5, to be more fully described hereinafter. This therefore amounts to a slow opening discharge. And, extension 44 of the inner end of the plunger head is contoured as at 45 to match the contour of the exposed end of plug 55 and the upper surface of flange 61. The remainder of extension 44 is contoured to match the interior of lip 59. Thus, as in FIG. 1, the accumulated air within pump chamber 27 may be expelled for priming by initially depressing the pump plunger head so that the complementarily contoured surfaces permit substantially all the accumulated air to be squeezed out of the pump chamber through the discharge.

Figure 4:
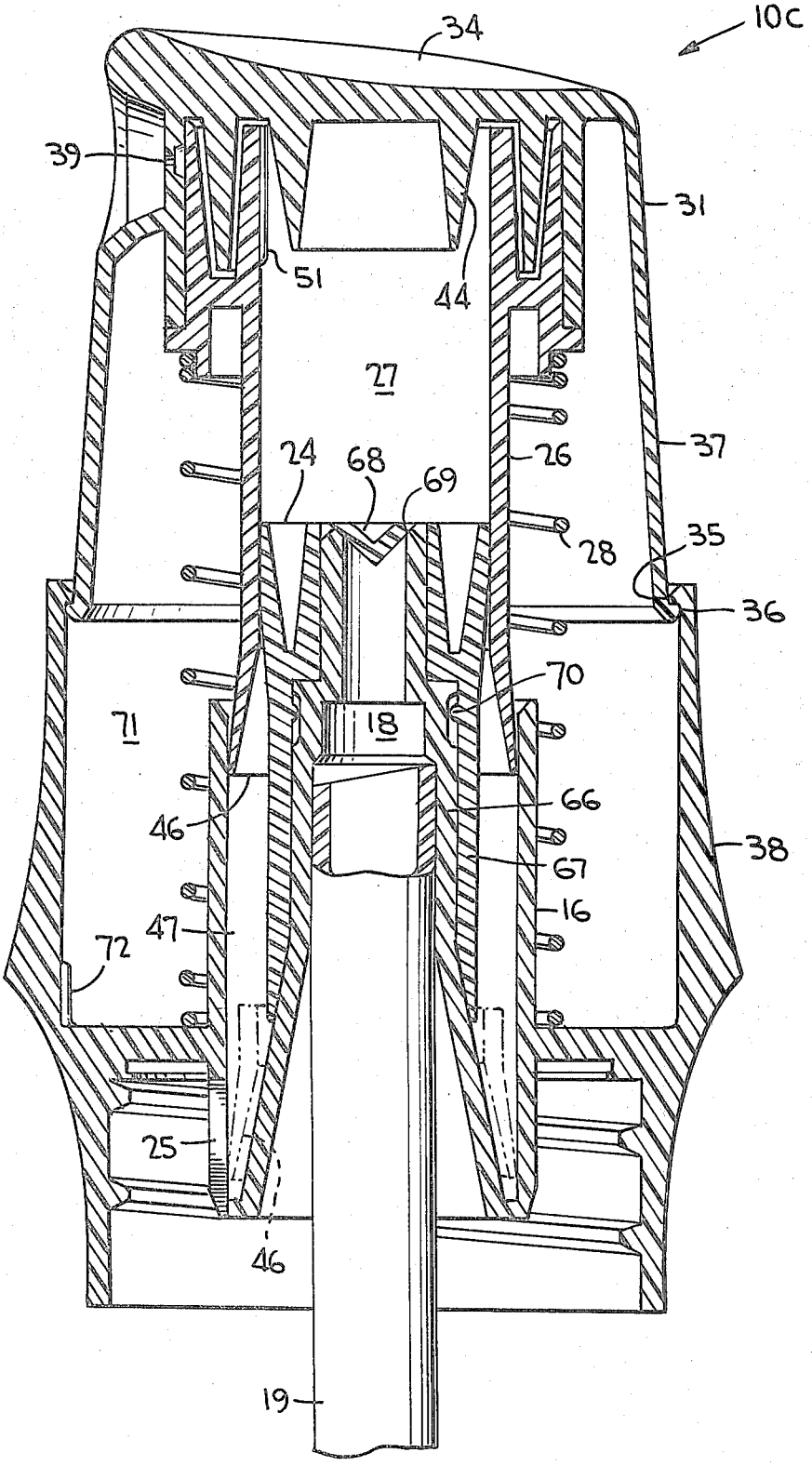
FIG. 4 is a vertical sectional view of a dispensing pump including the additional priming assist feature according to the present invention.

Dispensing pump 10C of FIG. 4 is similar to pump 10A of FIG. 2 except for the particular type of inlet valve and a means provided for additionally or alternately aiding in priming of the pump. Such a means is provided by skirt 37 and cylindrical wall 38 as being respectively spaced outwardly of the plunger and of wall 16 to thereby enclose the volume of space beneath plunger head 31. Skirt 37 functions as a piston relative to wall 38 upon reciprocation of the plunger head so that stop shoulder 36 is in sealing engagement with the inner surface of wall 38 throughout the reciprocating movement.

The stationary piston according to FIG. 4 is formed by an upstanding post 66 surrounded by a piston sleeve 67 having flexible lip 24 at its upper end. Also, the piston sleeve has an integrally moulded valve such as a resilient flap 68 normally against a valve seat 69 formed at the upper end of post 66 for closing the inlet through the hollow post during the compression stroke, the valve flap becoming unseated from the valve seat for opening the inlet during the suction stroke. The inlet valve may be in the form of a bunsen valve, or other alternate forms, and the piston sleeve may be retained on post 66 by an annular rib and groove 70.

Cooperating skirt 37 and wall 38 together define an air chamber 71 beneath the plunger head and outwardly of the plunger and wall 16. An axial rib 72 is disposed on the inner surface of wall 38 at the bottom thereof.

In operation, resilient lip 24 is inwardly distorted upon contacting rib 51 during the compression stroke so that the accumulated air in pump chamber 27 which is compressed during the downstroke of the plunger head, is caused to be vented upon this lip distortion from the pump chamber into the container via vent chamber 47 and vent opening 25 as skirt 46 is moved to its lowered position shown in phantom outline. The venting of the accumulated air from the pump chamber into the container, which is the same as that described for FIG. 2, momentarily compresses the surface of the liquid product in the container thereby giving the liquid a modest boost to aid in flowing product up the dip-tube. An additional or alternative means providing a similar booster effect is made possible by enclosing the volume beneath the plunger head in the manner of a piston and cylinder by causing head skirt 37 to follow the inside of wall 38 in the manner of a piston, not permitting the air thus compressed in chamber 71 to escape except into the container past vent skirt 46 until reaching a point near the inward end of the travel of the plunger (upon the inward distortion of the stop shoulder 36 when contacting rib 72) where all three passages are open—the pump chamber which communicates with the vent passage, the vent opening and air chamber 71 which communicates with the container interior via the vent opening between wall 16 and the plunger. The net effect can thus be a beneficial priming aid as compressed air from chamber 71 is dumped into the container in addition to the dumping of the compressed air from the pump chamber. Thus, for the primed pump, such a priming aid can help prevent cavitation of thixotropic products in the vicinity of the terminal end of the dip-tube, and will help prevent disassociation of the products which contain a substantial amount of air emulsified in a creamy substance, and which exhibits a substantial resistance to flow.

Figure 5:
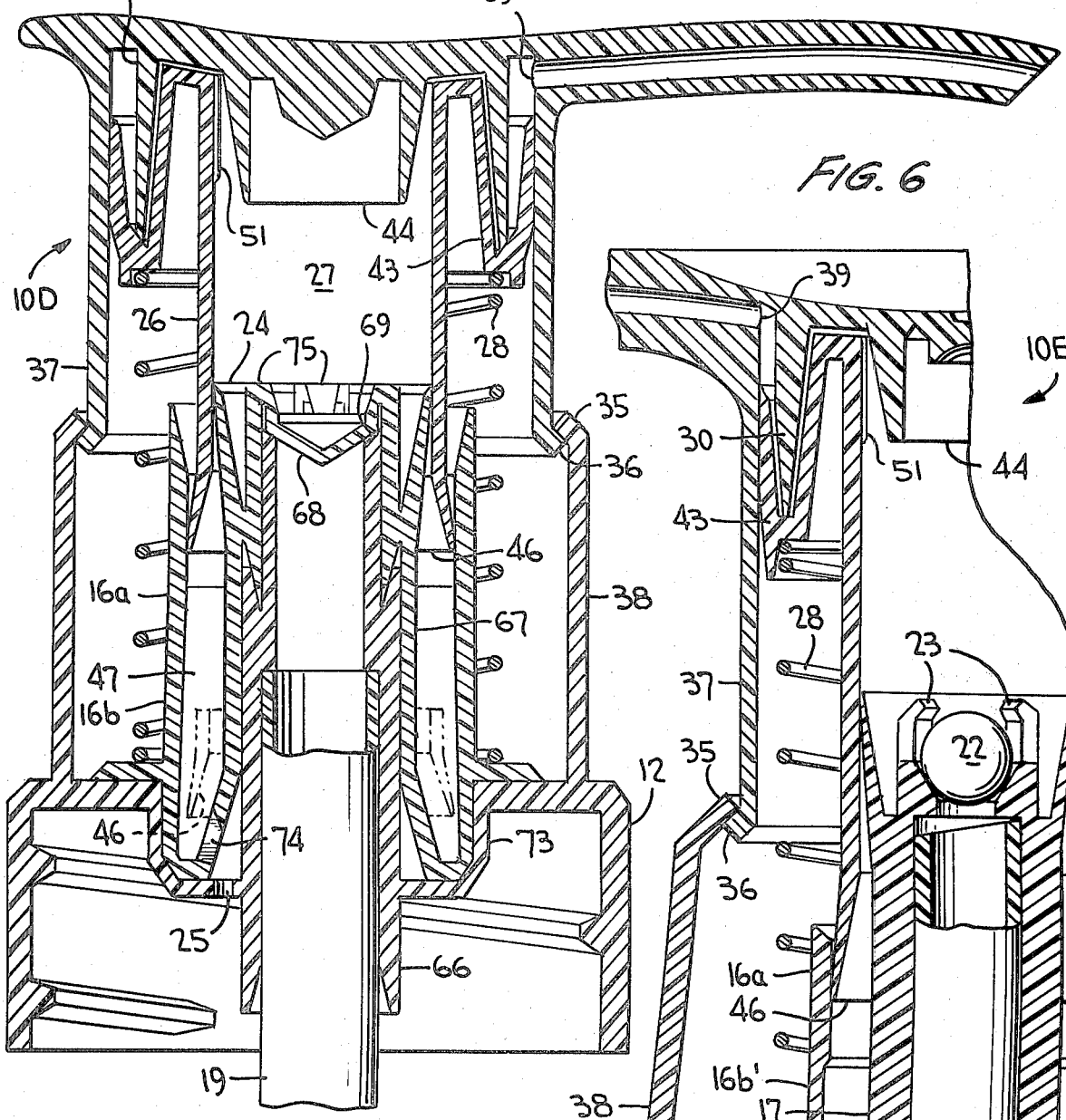
FIGS. 5 and 6 are vertical sections of still other embodiments of the dispenser according to the invention.

A dispensing pump 10D is shown in FIG. 5 as having a post 66 carrying the dip-tube similarly as shown in FIG. 4. However, piston sleeve 67 is made integral with wall **16*a* and is seated at its lower end within a cup shaped portion 73 of the pump body. Vent chamber 47 is in open communication with the interior of the container via vent opening 25 provided in this portion 73 and via an aperture 74 provided at the lower portion of the piston sleeve which lies outwardly of post 66**.

A flapper valve 68 is provided at the upper end of the piston sleeve and is resiliently urged into its seated position against valve seat 69 by means of integral valve springs 75.

As in FIGS. 2 and 4, a rib 51 is provided on the inner wall at the upper end of the plunger for establishing communication between pump chamber 27 and vent chamber 47 as lip 24 is inwardly distorted upon contacting the rib during the initial downstroke of the plunger head. The compressed accumulated air from chamber 27 is in such manner dumped into the container via openings 74 and 25. However, the interior of the container is vented to the atmosphere at the end of the plunger downstroke slightly differently as compared to the earlier-described embodiments. In FIG. 5, wall 16 is cylindrical at its upper portion **16*a* so that vent chamber 74 remains closed to the atmosphere by skirt 46 while in contact with this upper portion. Wall 16 extends gradually outwardly at its lower portion as at 16*b* so that a gradually increasing annular gap is formed between skirt 46 and the inner surface of this lower portion as the plunger extends to its phantom outline position. In this position, the container communicates with the atmosphere through a vent passage which extends through openings 25 and 74, vent chamber 47, and outwardly of the pump through the non-sealed engagement between shoulders 35 and 36**.

As in the aforedescribed embodiments, rib 51 may be eliminated and pump chamber 37 may be purged of accumulated air during priming by reason of the complementary contours at the upper end of the piston and at an opposing surface of a plunger head which acts on the larger diameter accumulation chamber causing the plunger to shift relative to the piston so as to open the discharge. A reversely bent portion of flange 43 at the upper end of the plunger is normally seated against the lower edge of ring 30 in the discharge closing position of the pump. In this embodiment, the terminal end of flange 43 lies below discharge orifice 39 so that only a slight relative shifting between the plunger and the piston opens the discharge as flange 43 is moved away from ring 30. Thus, a quick opening discharge is effected.

Figure 6:
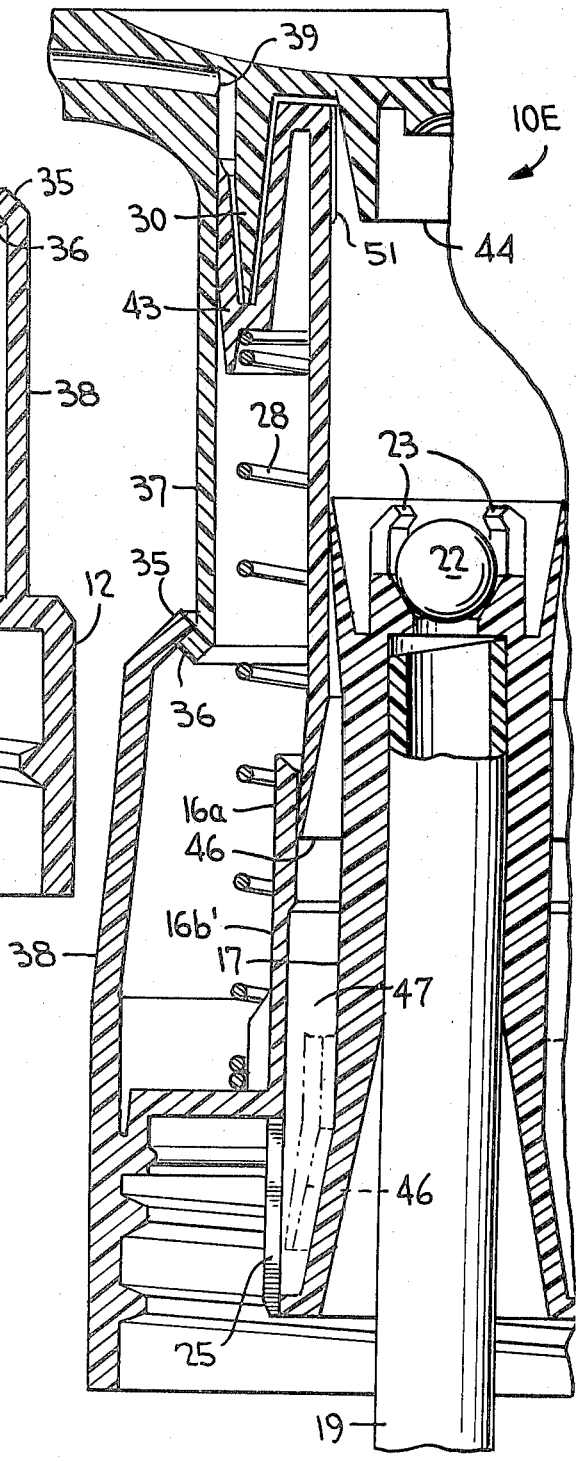

Such a quick opening discharge is likewise provided for dispenser 10E of FIG. 6 which is essentially the same as FIG. 5 except that the piston, wall 16 and the inlet valve are more similar to that of FIG. 1. Wall 16 has an upper cylindrical portion 16*a* similar as in FIG. 5, except that its lower portion 16*b*'has an inner diameter slightly greater than the inner diameter of portion 16*a*. Thus, the container will be opened to the atmosphere when the plunger moves during its downstroke to a position at which its skirt 47 projects into lower portion 16*b*'. It should be pointed out that wall 38 has a slightly enlarged lower cylindrical portion as compared to wall 38 of the earlier-described embodiments, and that the upper portion is conically shaped so as to assure the opening of the vent passage between shoulders 35 and 36 during the plunger head downstroke. As to the point where the wall 16 and vent skirt 46 of the plunger are disengaged, it can be seen that no product can leak out through the container vent until this is accomplished. Thus, if the container should be shipped inverted, the product could not leak out, even if the plunger is displaced somewhat inwardly from the fully extended position, as the vent passage remains closed until the vent skirt reaches the enlarged bore (FIG. 6) of wall 16, or until vent skirt 46 reaches the elongated vent slot 25 (FIGS. 1, 3, 4) in the pump body, or until the vent skirt moves beyond vent 25*a* (FIG. 2) and is inwardly distorted, or until the tapered bore (FIG. 5) disengages the vent skirt, depending on the chosen configuration of the vent chamber 47 bore, or the vent sleeve which engages the vent skirt and the plunger. By synchronizing these several elements, the dumped air can be used as a priming aid. It can also be used in conjunction with auxiliary boosted air from within chamber 71 under and within the plunger head. It can also be observed that the boosted air from under the plunger head can be used by itself, if the pump chamber air is expelled through the normal discharge passage 39. In addition, the synchronized booster pulse from both chambers 27 and 71 can be utilized as priming aids for products which are slow to self-level, or do not actually reach a level top surface, but must be sucked down toward the end of the dip-tube for ingestion into the pump. The length of ribs 51 and 72 can be chosen and synchronized so that the boosted pressure can be vented to the outside of the container at any desired point of inward travel, for that air within chamber 71, or can be held until the compressed air from chamber 27 is dumped into the container. After the pump is primed, ribs 51 and 52 are no longer operable as vents for the pump chamber, and are sufficiently thin so as to be of capillary dimensions which will not pass product under normally operating pressures for the pump. If by some form of misuse, the pump chamber pressure should reach a level which could pass some small amount of liquid via these vents, this by-pass would simply be returned to the interior of the container through vent chamber 47 and vent slot 25.

And, it should be pointed out that, in lieu of rib 51, a depending abutment or the like could be provided on the inner top surface of the head for compressing plunger skirt 24 inwardly so as to permit compressed air to escape from the pump chamber into vent chamber 47. Communication between chambers 27 and 47 can be still otherwised established by the provision of a groove or depression in the wall of the plunger.

From the foregoing it can be seen that several options for different types of valving and piston types are readily feasible. The various combinations of components disclosed can be switched around by adding components. Further choices permit exclusion of metal parts from contact with the product, and add the feature of self-closing inlet valves in several of the aforedescribed embodiments. In the case of the integral flapper or poppet valves shown (bunsen valves are also possible), the valves close automatically at the end of the suction stroke. For the sliding, or reciprocating piston of FIG. 3, the intake valve is closed automatically by piston movement as the plunger is depressed. This separately molded piston member affords the choice of a softer, more resilient material for the piston while a tougher, more rigid material may be chosen for the pintle.

Tests have verified that pumps according to the invention, without lock rings or other means to prevent plunger actuation, do not leak even when shipped inverted. And, if the weight of the filled container, or the incidental loads of the shipping and storage environment on the top of the plunger do not exceed the normal force to actuate the pump, even if primed, there will be no dispensing or leaking from the pump or from the vents.

Obviously, many other modifications and variations of the present invention are made possible in the light of the above teachings. It is therefore to be understood that within the scope of the appended claims the invention may be practiced otherwise than as specifically described.

What is claimed is:

1. In a liquid dispenser comprising a pump body sealingly mounted on a container of flowable product to be dispensed, said body having a container vent opening therein and a stationary piston thereon, an annular plunger resiliently urged into a fully raised position and mounted for reciprocation on said piston to define therewith a variable volume pump chamber, a valve controlled inlet passage in said piston, a plunger head slidably disposed on said plunger and having a discharge passage adapted to be opened and closed by said plunger upon an increase in pressure within said chamber, the improvement wherein means are provided for opening and closing said vent opening upon reciprocation of said plunger, said means comprising a vertical first cylindrical wall spaced from and surrounding said piston so as to therewith define a vent chamber which is in open communication with the interior of the container via said vent opening, means defining a container vent passage extending from the interior of the container via said vent opening and said open vent chamber, outwardly of said plunger and outwardly of said plunger head, said opening and closing means further comprising skirt means on said plunger in sealing engagement with an inner surface of said wall for closing said vent passage while said plunger is in its raised position and during an initial downstroke reciprocation thereof, said skirt means being further adapted to open said vent passage upon a further downstroke reciprocation of said plunger, whereby the interior of the container is vented to atmosphere only during said further downstroke reciprocation, and any leakage of product from the container through said vent passage is positively prevented while said plunger is in said raised position and during said initial downstroke.

2. In the dispenser according to claim 1, wherein said vent opening is located in said cylindrical wall at a lower portion thereof for establishing communication between the interior of the container and the atmosphere upon said further downstroke reciprocation of said plunger.

3. In the dispenser according to claim 1, wherein said wall has an enlarged lower portion defining a gap with said skirt means during said further downstroke reciprocation, said gap defining a portion of said passage.

4. In the dispenser according to claim 3, wherein said inner surface of said wall has a first predetermined diameter at an upper portion thereof for establishing the sealing engagement with said skirt means, and said lower portion at its lower end having a second large predetermined diameter with said surface smoothly tapering between said diameters, whereby said vent passage is gradually opened between said diameters during the downstroke reciprocation.

5. In the dispenser according to claim 3, wherein said inner surface of said wall has a first predetermined diameter at an upper portion thereof for establishing the sealing engagement with said skirt means, and the remainder of said inner surface has a second, larger and constant predetermined diameter.

6. In the dispenser according to claims 1, 2, 3, 4 or 5, wherein the upper end of said piston and an opposing inner surface of said plunger head are complementarily contoured so that the pump may be effectively primed as any air within said pump chamber is substantially evacuated through said discharge passage upon depressing said head.

7. In the dispenser according to claims 1, 2, 3, 4 or 5, wherein means are provided at an upper inner end of said plunger for establishing communication between said pump chamber and said vent chamber near the end of the downstroke reciprocation upon contact between said piston and said establishing means, whereby the dispenser may be primed as any air within said pump chamber is compressed before said vent is opened and is substantially evacuated into the container under compression at the time said vent is opened to thereby boost the product within the container to serve as an aid in priming.

8. In the dispenser according to claim 7, wherein said establishing means comprises a first axial rib and said piston includes an annular lip seal of resilient material at the upper end thereof, whereby said lip seal is distorted upon contact with said rib during relative reciprocating movement between said plunger and said piston.

9. In the dispenser according to claim 1, wherein said vent is located in said cylindrical wall between opposite ends thereof, means being provided on an upper inner end of said plunger and on a lower inner end of said wall below said vent opening for establishing communication between said pump chamber and said vent chamber near the end of the downstroke reciprocation upon contact between said establishing means and said piston and between said establishing means and said skirt means, whereby the dispenser may be primed as any air within said pump chamber is compressed before said vent is opened and is substantially evacuated into said container under compression at the time said vent is opened to thereby boost the product within the container to serve as an aid in priming.

10. In the dispenser according to claim 9, wherein said establishing means comprise axial ribs, the upper end of said piston and said skirt means defining annular lip seals of resilient material, whereby said lip seals are distorted upon contact with said ribs during relative reciprocating movement between said plunger and said piston.

11. In the pump according to claims 1, 2, 3, 4 or 5, wherein means for priming the pump comprise a variable volume air chamber defined by a piston wall portion on said head spaced from said plunger and a cylindrical wall portion on said body spaced from said first wall, annular cooperating stop shoulders on said wall portions for arresting the upward movement of said head, and means at a lower inner end of said cylindrical wall portion for opening said air chamber to atmosphere, whereby upon depressing said head the air within said air chamber is compressed before said vent is opened to thereby boost the product within the container when said vent is opened to serve as an aid in priming, said means at said lower inner end establishing said vent passage when said head nears the end of the downstroke.

12. In the dispenser according to claim 11, wherein said stop shoulder on said piston wall is of resilient material, and sealingly engages an inner surface of said cylindrical wall portion, and said means on said inner end comprising an axial rib, said vent passage thereby established upon distortion of said piston wall stop shoulder when contacting said rib.

13. In the dispenser according to claim 7, wherein additional means for priming the pump comprise a variable volume air chamber defined by a piston wall portion on said head spaced from said plunger and a cylindrical wall portion on said body spaced from said first wall, annular cooperating stop shoulders on said wall portions for arresting the upward movement of said head, and means at a lower inner end of said cylindrical wall portion for opening said air chamber to atmosphere, whereby upon depressing said head the air within said air chamber is compressed before said vent is opened to thereby boost the product within the container when said vent is opened to serve as an aid in priming, said means at said lower inner end establishing said vent passage when said head nears the end of the downstroke.

14. In the dispenseer according to claims 1, 2, 3, 4 or 5, wherein said head has a downwardly directed blind socket so as to define with said plunger a variable volume accumulation chamber between said plunger and the blind end of said socket and being in open communication with said pump chamber, said discharge passage being opened and closed by relative movement between said head and said plunger, said blind socket including an annular ring depending from the top of said head, the upper end of said plunger having an annular groove engaging said ring and defining an annular discharge valve flange, said flange having a terminal end lying above said discharge passage so as to define a slow acting discharge valve.

15. In the dispenser according to claims 1, 2, 3, 4 or 5, wherein said head has a downwardly directed blind socket so as to define with said plunger a variable volume accumulation chamber between said plunger and the blind end of said socket and being in open communication with said pump chamber, said discharge passage being opened and closed by relative movement between said head and said plunger, said blind socket including an annular ring depending from the top of said head, the upper end of said plunger having an annular groove engaging said ring and defining an annular discharge valve flange, said flange having a terminal end lying below said discharge passage so as to define a quick acting discharge valve.

* * * * *